US008172534B2

(12) United States Patent
Ammann et al.

(10) Patent No.: US 8,172,534 B2
(45) Date of Patent: May 8, 2012

(54) TURBINE BLADE OR VANE WITH IMPROVED COOLING

(75) Inventors: Luke John Ammann, Simpsonville, SC (US); James William Vehr, Easley, SC (US); Gunnar Leif Siden, Greenville, SC (US); Wei Ning, Greenville, SC (US)

(73) Assignee: General Electric Company, Schenectady, NY (US)

( * ) Notice: Subject to any disclaimer, the term of this patent is extended or adjusted under 35 U.S.C. 154(b) by 587 days.

(21) Appl. No.: 12/356,874

(22) Filed: Jan. 21, 2009

(65) Prior Publication Data

US 2010/0183446 A1 Jul. 22, 2010

(51) Int. Cl.
*F01D 5/08* (2006.01)

(52) U.S. Cl. ..... 416/97 R

(58) Field of Classification Search ..... 416/97 R, 416/95, 115, 224, 235, 236 R, 236 A; 415/115
See application file for complete search history.

(56) References Cited

U.S. PATENT DOCUMENTS 4,835,958 A 6/1989 Rice
6,092,982 A * 7/2000 Ikeda et al. ..... 415/115
6,241,466 B1 * 6/2001 Tung et al. ..... 415/115
7,387,492 B2 * 6/2008 Pang et al. ..... 416/97 R
7,887,294 B1 * 2/2011 Liang ..... 416/97 R
2003/0223870 A1 * 12/2003 Keith et al. ..... 416/97 R
2005/0095129 A1 * 5/2005 Benjamin et al. ..... 416/97 R
2005/0265837 A1 12/2005 Liang
2006/0239819 A1 * 10/2006 Albert et al. ..... 416/97 R
2006/0248719 A1 * 11/2006 Szela et al. ..... 29/889.7
2007/0140835 A1 6/2007 Albrecht et al.
2007/0140850 A1 * 6/2007 Pang et al. ..... 416/97 R
2009/0169395 A1 * 7/2009 Wilson et al. ..... 416/97 R
2010/0111699 A1 * 5/2010 Morris et al. ..... 416/219 R

FOREIGN PATENT DOCUMENTS

EP 1245786 A2 10/2002

OTHER PUBLICATIONS

EP Search Report for EP Application 10151142.6. Mailing Date Jun. 8, 2010.

* cited by examiner

*Primary Examiner* — Matthew Landau
*Assistant Examiner* — Joseph C Nicely
(74) *Attorney, Agent, or Firm* — Cantor Colburn LLP

(57) ABSTRACT

Disclosed is a turbine blade or vane including a blade or vane body including a leading edge and a trailing edge, a plurality of cooling openings disposed along the trailing edge, a first width of the trailing edge, the first width being disposed across the cooling openings, and a second width of the trailing edge the second width being disposed between the cooling openings, wherein the second width is smaller than the first width.

10 Claims, 4 Drawing Sheets

TURBINE BLADE OR VANE WITH IMPROVED COOLING

BACKGROUND OF THE INVENTION

The subject matter disclosed herein relates generally to turbine blade design, and more particularly to design of a trailing edge of a turbine blade or vane. Two standard concerns in trailing edge technology are aerodynamic efficiency (or blockage) and cooling. Sometimes improvements in aerodynamic efficiency can lead to reduction in cooling effectiveness, and vice versa. For example, using a pressure side discharge can improve aerodynamic efficiency, but reduce effectiveness of cooling. Accordingly, a trailing edge design that both improves aerodynamic efficiency and airfoil cooling would be desirable.

BRIEF DESCRIPTION OF THE INVENTION

Disclosed is a turbine blade including a blade body including a leading edge and a trailing edge, a plurality of cooling openings disposed along the trailing edge, a first width of the trailing edge, the first width being disposed across the cooling openings, and a second width of the trailing edge the second width being disposed between the cooling openings, wherein the second width is smaller than the first width.

These and other advantages and features will become more apparent from the following description taken in conjunction with the drawings.

BRIEF DESCRIPTION OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION OF THE INVENTION

Figure 3:
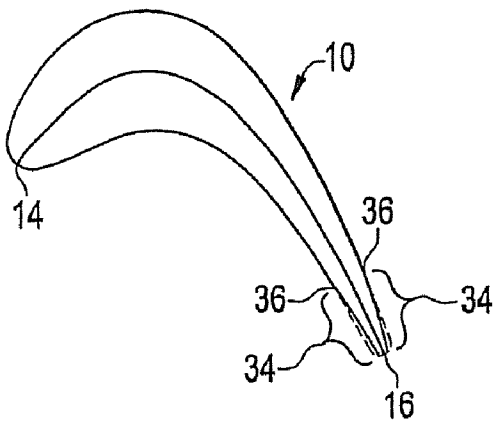
FIG. 3 is a planar, cross-sectional view of the turbine blade of FIG. 1.
Figure 2:
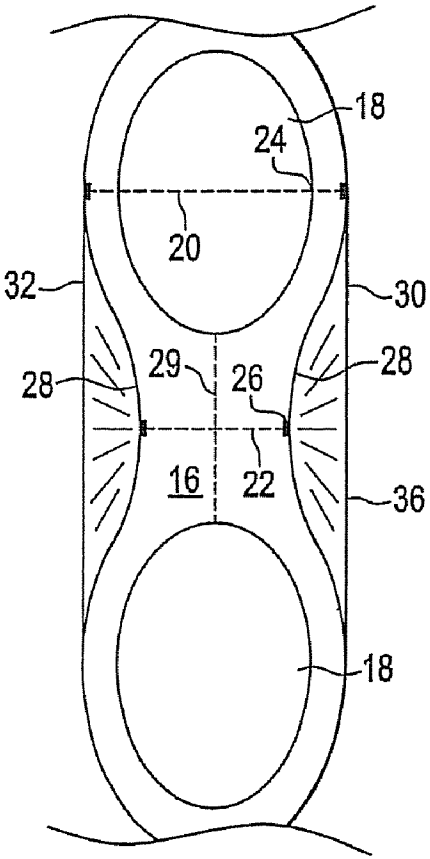
FIG. 2 is an elevated view of a section of the turbine blade of FIG. 1.
Figure 1:
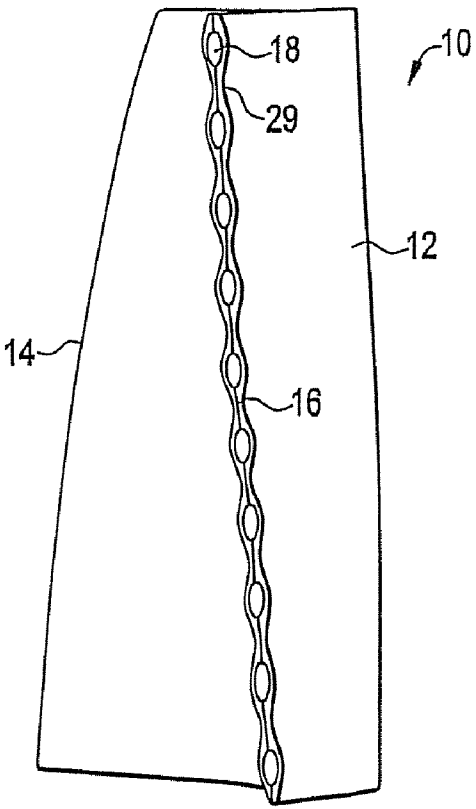
FIG. 1 is a side perspective view of a turbine blade in accordance with a first exemplary embodiment.

Referring to FIGS. 1-3, an aerodynamically efficient turbine blade 10 with improved cooling is illustrated. The blade 10 includes a blade body 12, with a leading edge 14 and a trailing edge 16. As is best shown in FIG. 1, the trailing edge 16 of the blade 10 includes a plurality of cooling openings 18. As is best shown in FIG. 2, and will be described in greater detail hereinbelow, the trailing edge also includes a first width 20 at the cooling openings 18, and a second width 22 between the openings 18.

With particular reference to FIGS. 1 and 2, an exemplary embodiment is illustrated wherein the first width 20 is greater than the second width 22. In this exemplary embodiment, the first width 20 is largest across a relative midpoint or diameter 24 of the cooling openings 18, and the second width 22 is smallest at a relative midpoint 26 between the cooling openings 18. The difference in size of the widths 20 and 22 is created via a concavity 28 formed (via molding, machining, or any other procedure known in the art) at the trailing edge 16. In the embodiment of FIGS. 1-3, this concavity 28 is directed into the blade body 12 towards a centerline 29 of the trailing edge 16 from both the suction side 30 and pressure side 32 of the trailing edge 16 and blade region 34 in a desirable proximity to the trailing edge 16.

In the exemplary embodiments of FIGS. 1-3, the concavities 28 also extend from the trailing edge 16 towards the leading edge to an innermost extent 36 of the concavity 28, the innermost extent 36 being disposed at a length of at least one quarter the depth of the concavity from the trailing edge 16 in this exemplary embodiment. As is additionally shown in FIGS. 1-3, the second width 22, as formed by the concavity 28, increases over a distance taken from the trailing edge 16 towards the innermost extent 36, such that the second width 22 becomes substantially equal to the first width 20 at the innermost extent 36. This is particularly well represented by the broken ghost lines shown in the cross-sectional view FIG. 3, wherein the solid lines in proximity to the trailing edge 16 illustrate the width 22 an area between the openings 18, and the broken ghost lines in proximity to the trailing edge 16 illustrate the width 20 at the midpoint 26 of the openings 18.

Figure 6:
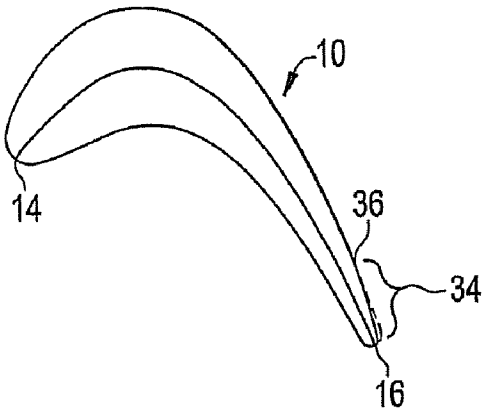
FIG. 6 is a planar, cross-sectional view of the turbine blade of FIG. 4.
Figure 5:
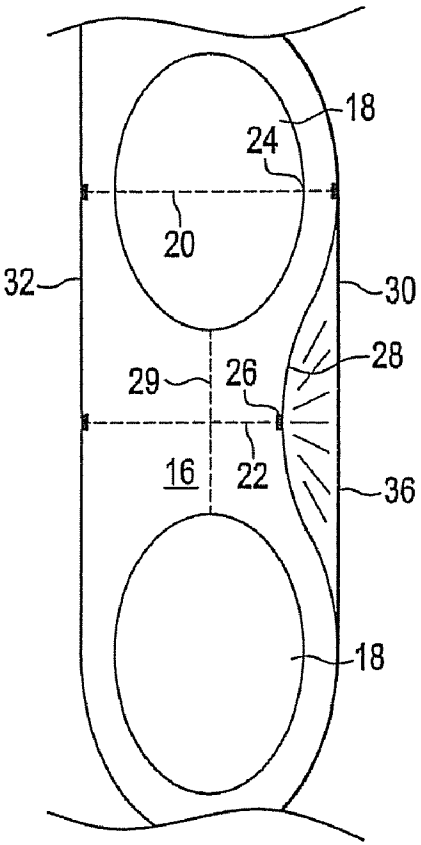
FIG. 5 is an elevated view of a section of the turbine blade of FIG. 4.
Figure 4:
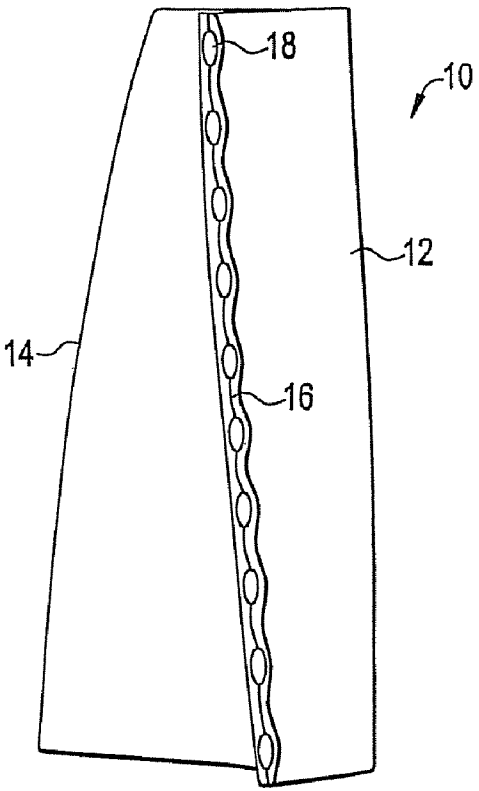
FIG. 4 is a side perspective view of a turbine blade in accordance with another exemplary embodiment.

Referring now to FIGS. 4-6, another exemplary embodiment is illustrated wherein the turbine blade 10 includes the concavity 28 at the suction side 30 only. In this embodiment, the second width 22 is again smaller than the first width 20, but the difference in size of the widths 20 and 22 is created via a concavity 28 formed at the suction side 30.

Figure 9:
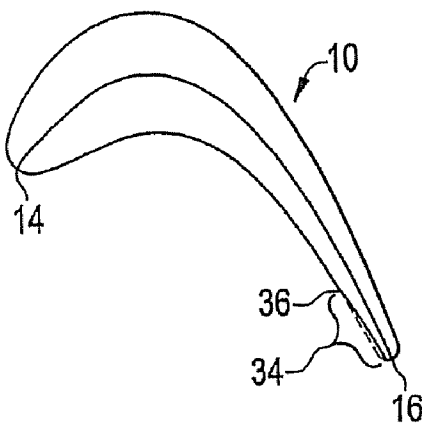
FIG. 9 is a planar, cross-sectional view of the turbine blade of FIG. 7; and, FIG. 10 is an elevated view of a section of a turbine blade in accordance with another exemplary embodiment The detailed description explains embodiments of the invention, together with advantages and features, by way of example with reference to the drawings.
Figure 8:
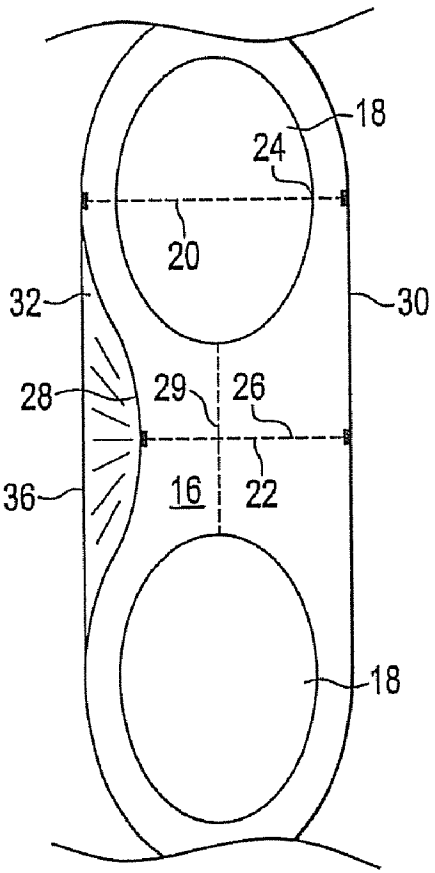
FIG. 8 is an elevated view of a section of the turbine blade of FIG. 7.
Figure 7:
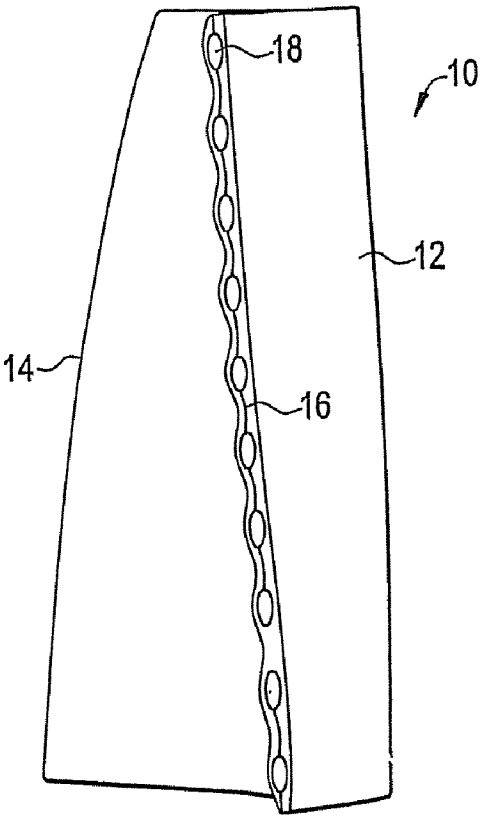
FIG. 7 is a side perspective view of a turbine blade in accordance with another exemplary embodiment.

Referring next to FIGS. 7-9, still another exemplary embodiment is illustrated wherein the turbine blade 10 includes the concavity 28 at the pressure side 32 only. In this embodiment, the second width 22 is again smaller than the first width 20, but the difference in size of the widths 20 and 22 is created via a concavity 28 formed at the pressure side 32.

Figure 10:
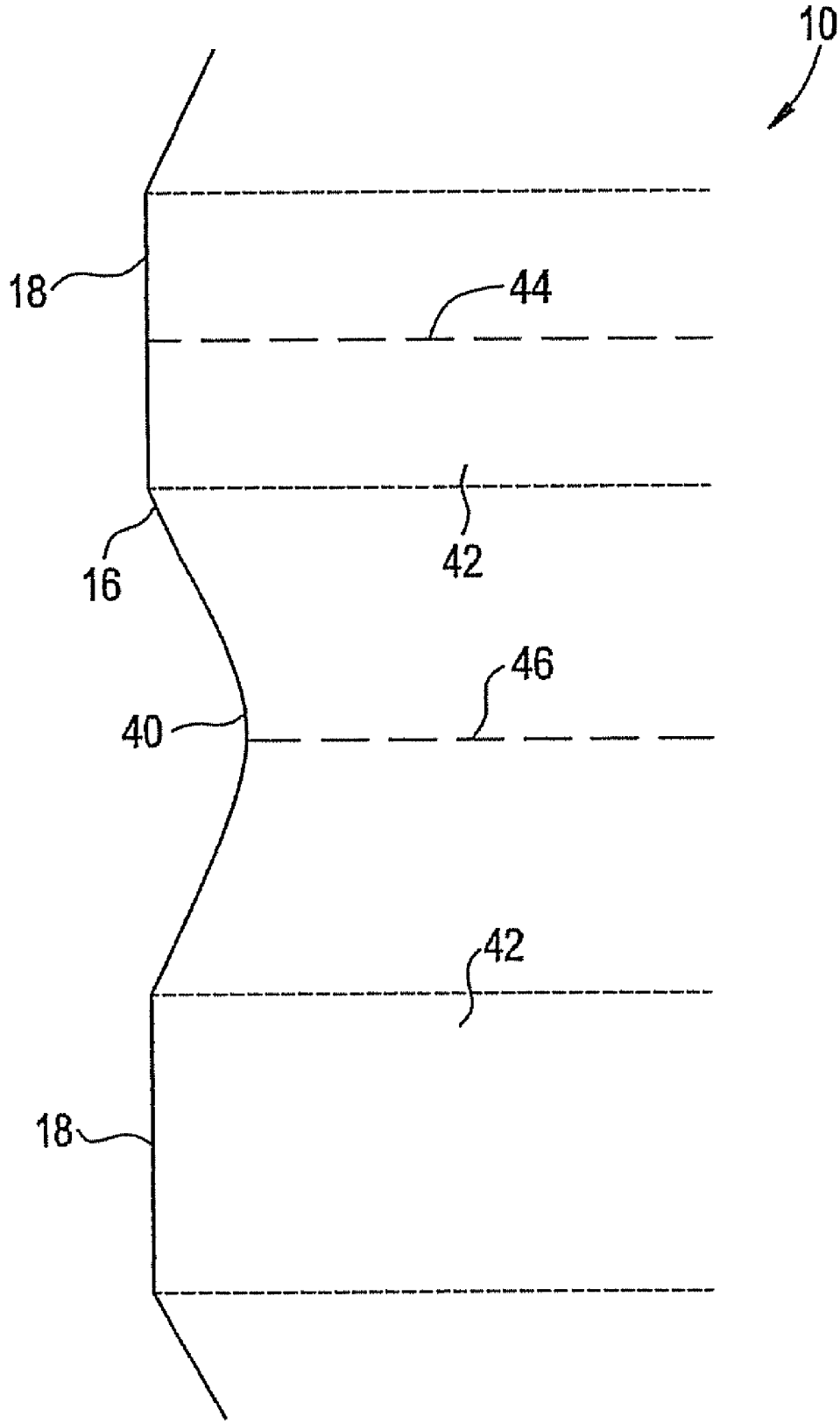

Referring further to FIG. 10 still another exemplary embodiment is illustrated wherein the trailing edge 16 of the turbine blade 10 includes a concavity 40 disposed between the cooling openings 18 in a direction towards the leading edge 14, or with channels 42 extending into the blade body 12 from the openings 18. This concavity 40 allows the blade 10 to include a first length 44 from the trailing edge 16 to the leading edge 14 and a second length 46 from the trailing edge 16 to the leading edge 14. As is shown in FIG. 10, the concavity causes the first length 44 to be greater than the second length 46, creating the contoured trailing edge geometry that is illustrated in this Figure.

The local thinning described throughout the trailing edge embodiments of this Application reduce trailing edge blockage, thereby improving turbine efficiency. The trailing edge shape achieved via these embodiments also reduces areas in the trailing edge that are further from the cooling holes which are more difficult to cool. This in turn reduces the amount of cooling air required to cool the trailing edge. Such a shape induces streamlines that run along the axis of the turbine, reducing temperature migration to down stream stages of the turbine. This reduction in migration reduces the temperature on the end wall of the flow path, and improves the overall reliability of the turbine.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A turbine blade or vane comprising:

a blade or vane body including a leading edge and a trailing edge;

a plurality of cooling openings disposed along said trailing edge;

a first width of said trailing edge, said first width being disposed across said cooling openings; and a second width of said trailing edge said second width being disposed between said cooling openings, wherein said second width is smaller than said first width, via a concavity between each of said plurality of cooling openings, said concavity being directed into said blade body towards a centerline of said trailing edge.

2. The blade of claim 1, wherein said first width is largest at a relative midpoint of each of said plurality of cooling openings.

3. The blade of claim 1, wherein said second width is smallest at a relative midpoint between each of said plurality of cooling openings.

4. The blade of claim 1, wherein said concavity is disposed along a pressure side of said trailing edge.

5. The blade of claim 1, wherein said concavity is disposed along a suction side of said trailing edge.

6. The blade of claim 1, wherein said concavity is disposed along a pressure side and a suction side of said trailing edge.

7. The blade of claim 1, wherein said concavity extends from said trailing edge towards said leading edge to an innermost extent at a length of at least one quarter the depth of the concavity.

8. The blade of claim 7, wherein said second width increases from said trailing edge to said innermost extent of said concavity over said length of said concavity.

9. The blade of claim 8, wherein said second width is substantially equal to said first width at said innermost extent of said concavity.

10. A turbine blade comprising:

a blade or vane body including a leading edge and a trailing edge;

a plurality of cooling openings disposed along said trailing edge;

a first width of said trailing edge, said first width being disposed across said cooling openings;

a second width of said trailing edge said second width being disposed between said cooling openings, wherein said second width is smaller than said first width via a concavity between each of said plurality of cooling openings, said concavity being directed into said blade body towards a centerline of said trailing edge;

a first length extending from said trailing edge to said leading edge, said first length extending from a portion of said trailing edge that defines at least one of said cooling opening; and a second length extending from said trailing edge to said leading edge, said second length extending from a portion of said trailing edge disposed between said cooling openings, wherein said second length is smaller than said first length.

* * * * *